US005482206A

United States Patent [19]

Waycasy

[11] Patent Number: 5,482,206

[45] Date of Patent: Jan. 9, 1996

[54] AUTOMATIC MAIL DELIVERY SIGNALING DEVICE

[76] Inventor: Cecil M. Waycasy, 345 S. 1230 East, Spanish Fork, Utah 84660

[21] Appl. No.: 276,632

[22] Filed: Jul. 18, 1994

[51] Int. Cl.[6] ..... B65D 91/00

[52] U.S. Cl. ..... 232/35

[58] Field of Search ..... 232/35

[56] References Cited

U.S. PATENT DOCUMENTS

| | | | |
|---|---|---|---|
| 4,778,103 | 10/1988 | Nelson | 232/35 |
| 4,836,441 | 6/1989 | Crider | 232/35 |
| 4,913,342 | 4/1990 | Fluck | 232/35 |
| 4,986,467 | 1/1991 | Bibbee | 232/35 |
| 5,004,148 | 4/1991 | Windrem | 232/35 |
| 5,076,337 | 12/1991 | Reuter | 232/35 |

*Primary Examiner*—Michael J. Milano
*Attorney, Agent, or Firm*—Delbert Phillips

[57] ABSTRACT

A signaling device that is constructed and adapted for easy installation to residential street mailboxes is described. The unit is triggered by opening the mailbox door, yet there are no attachments, hardware, holes or connections to the mailbox door. The unit operates automatically when the mail box door is opened, yet there are no batteries, motors, springs, clips or power devices. The user sees only a plastic housing and a flag that operates as a signaling device.

3 Claims, 3 Drawing Sheets

FIG. 4
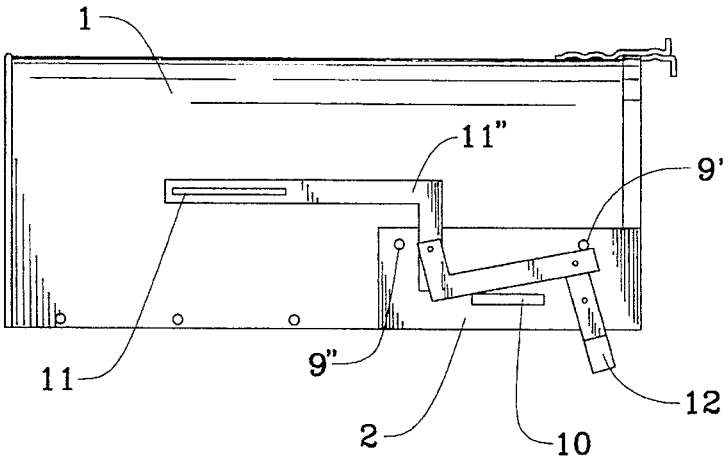
FIG. 5
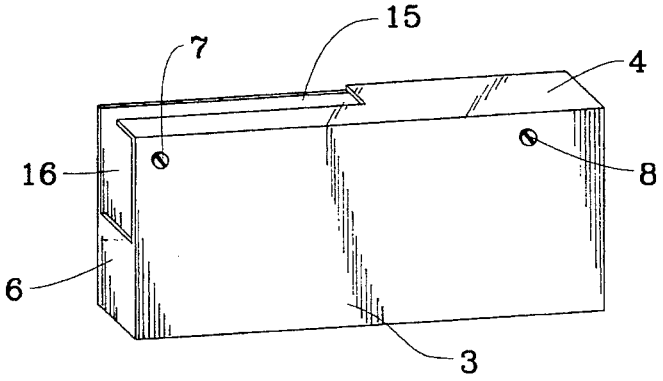
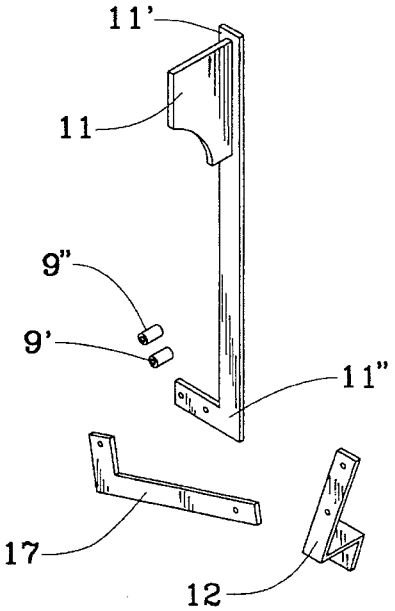
FIG. 6

AUTOMATIC MAIL DELIVERY SIGNALING DEVICE

SUMMARY OF THE INVENTION

The Automatic Mail Delivery Signaling Device is a unique signaling device which will signal residents when they have mail. The invention is different from any previous similar type units. The invention is a signaling device that can be installed on mailboxes which are now being placed along the streets in record numbers throughout the United States. The invention is made of 100% injection molded plastic for lightweight, weather resistant, rustproof, long lasting durability. All exterior parts of the Automatic Mail Delivery Signaling Device have smooth edges to prevent possible injury to the user. The invention works automatically when the mailbox door is opened, without springs, clips, wires or catches. The device operates by use of the human hand and gravity. There are no batteries, motors, springs nor power devices. The signaling flag is 9 inches tall which protrudes above the mailbox to allow clear visibility from any reasonable distance. The device has only three moving parts which are all made of plastic. The invention is triggered by opening the mailbox door, yet there are no attachments, hardware, holes or connections to the mailbox door. The invention is a one-piece unit which installs in minutes with two machines screws and acorn nuts. The device is designed to endure inclement weather due to moisture. The Automatic Mail Delivery Signaling Device can be installed on approximately 95 percent of all mailboxes and with minor alterations to the remaining 5 percent of mailboxes.

BRIEF DESCRIPTION OF DRAWINGS

FIG. 4: Shows Mail-Alert with the front cover removed and the location of all parts when unit is in the non-signaling position.

FIG. 5: Shows Mail-Alert front cover.

FIG. 6: Shows individual parts which are located inside Mail-Alert.

DETAILED DESCRIPTION

Figure 1:
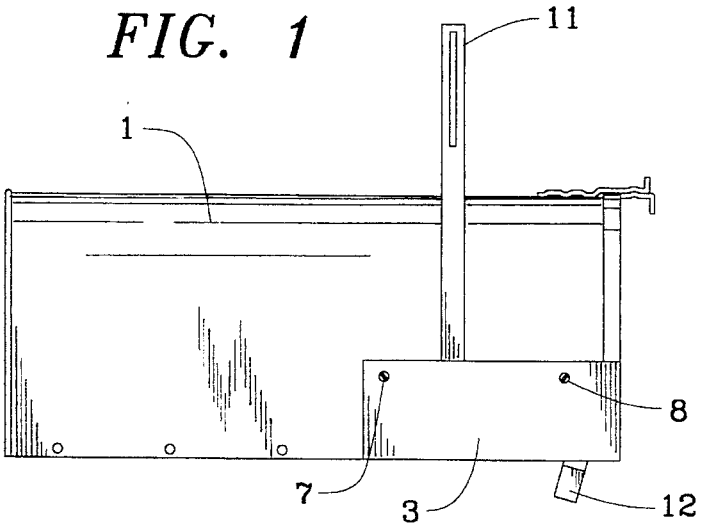
FIG. 1: Shows Mail-Alert while in the signaling position. (mail has arrived and is inside mailbox).
Figure 2:
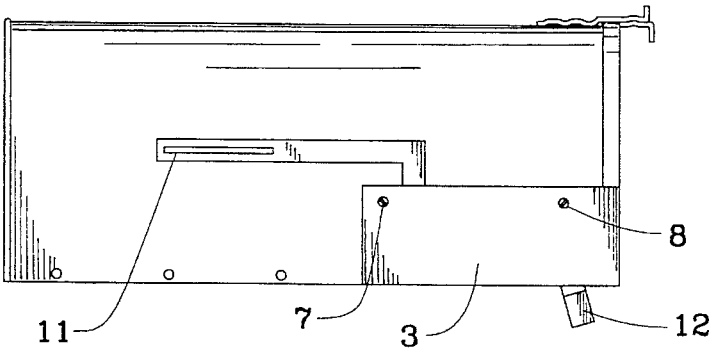
FIG. 2: Shows Mail-Alert while in the non-signaling position. (mail has not arrived or no mail was received).

Automatic Mail Delivery Signaling Device is a signal device which installs on residential mailboxes. The invention is a 6"×3"×¾, 100% injection molded plastic box. All moving parts are made of 100% plastic and rotate on plastic swivel posts.

The mail delivery signaling device has a rectangular enclosure with a backboard 2, a front cover 3, a top plate 4, a bottom plate 5, a side plate 6, first and second machine screws 7 and 8, first and second collar 9' and 9", forward flag stop 10, a flag 11, a trigger arm 12, and a flag connecting lever 17. The enclosure is attached to the mail box 1 by first and second machine screws 7 and 8. The machine screws 7 and 8 pass through the front cover 3 and the backboard 2. The first and second machine screws 7 and 8 are surrounded by a first and second collar 9' and 9" that form spacers between the front cover 3 and backboard 2. The first and the second machine screws 7 and 8 pass through holes drilled in the side of the mail box 1. The first and second machine screws 7 and 8 have acorn nuts (not shown) threaded on the free ends which extend through the side of the mail box 1. The second collar 9" is positioned adjacent to the side plate 6 and functions as a back flag stop. The forward flag stop 10 is firmly attached to the backboard 2. The forward flag stop 10 is located to support the vertical position of the flag 11. The backboard 2 has a first and second attachment points. The first attachment point has the trigger arm 12 pivotally attached. The second attachment point has the flag 11 pivotally attached. The trigger arm 12 has a first end and a second end. The first end of the trigger arm 12 is pivotally attached to the flag connecting lever 17. The second end of the trigger arm 12 is shaped in a manner to engage the mail box door 14 as it is lowered. The flag connecting lever 17 has a first and second end. The first end of the flag connecting lever 17 is pivotally attached to the trigger arm 12. The second end of the flag connecting lever 17 has a member attached at an angle to provide leverage for raising the flag 11. The member of the second end of the flag connecting lever 17 is an integral part of the flag connecting lever 17. The flag connecting lever 17 is pivotally connected to the flag 11 adjacent to the end of the member of the flag connecting lever 17. The flag 11 has a first end 11' and a second end 11". The first end 11' of the flag 11 has a projection at a right angle from the surface of the flag 11. The second end 11" of the flag 11 is "L" shaped. The second end 11" of the flag 11 is pivotally connected to the flag connecting lever 17 at the inner aspect of the right angle formed by the "L" shape of the second end 11" of the flag 11. The flag 11 is pivotally connected to the flag connecting lever 17 at a position adjacent to the second end 11" of the flag 11. The front flag stop is placed to engage the outer aspect of the "L" shape of the second end 11" of the flag 11, The forward flag stop 10 supports the flag 11 in a vertical position in respect to the bottom plate 5 when the flag 11 is in a vertical position. The bottom plate 5 has a slot allowing movement of the trigger arm 12. The trigger arm 12 protrudes through the slot 13 in the bottom plate 5 allowing the trigger arm 12 to engage the mail box door 14. The top plate 4 has a slot 15 allowing movement of the flag from a horizontal to vertical position. The side plate 6 has a slot adjacent to the top plate 4 accommodating the flag in a horizontal position, and the second collar 9" is located to act as back flag stop.

Figure 3:
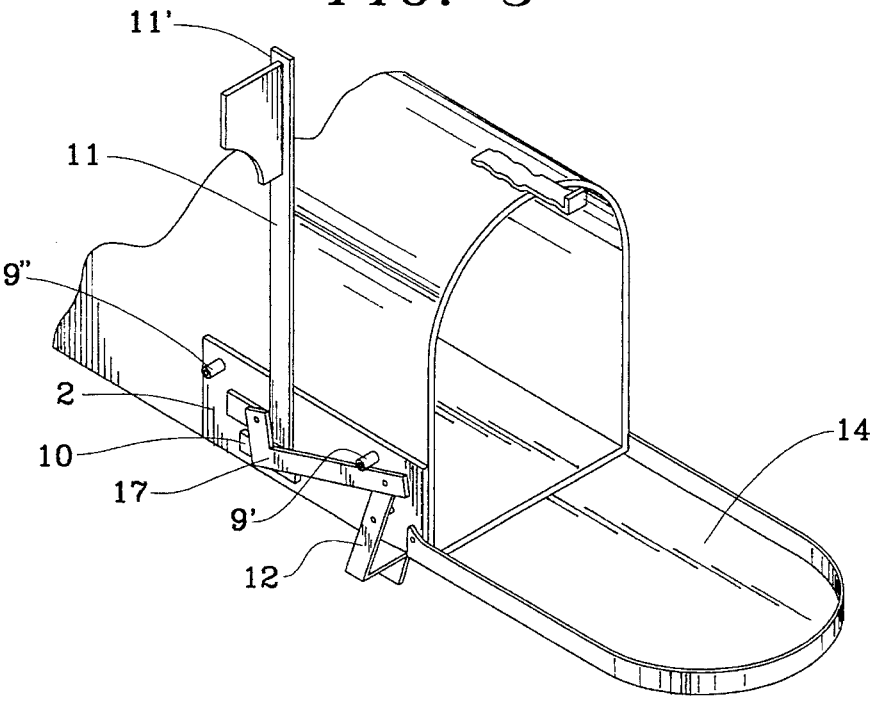
FIG. 3: Shows Mail-Alert with the front cover removed and the location of all parts when unit is in the signaling position.
Figure 7:
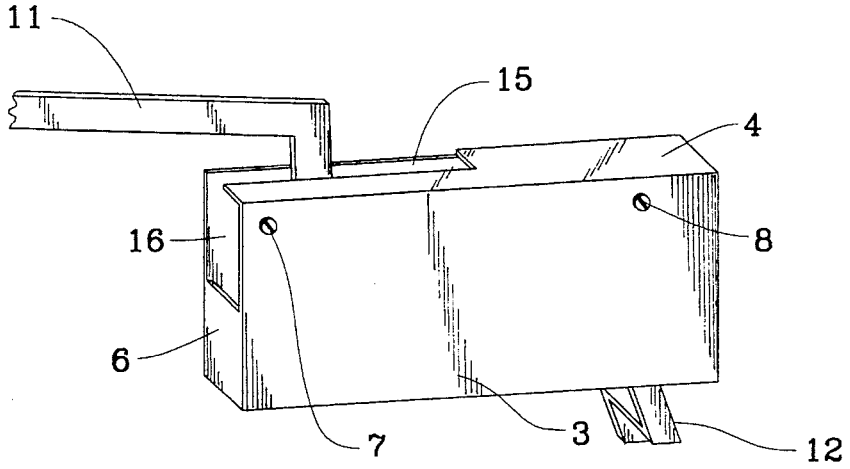
FIG. 7: Shows front cover and highlights slot which allows for flag movement.
Figure 8:
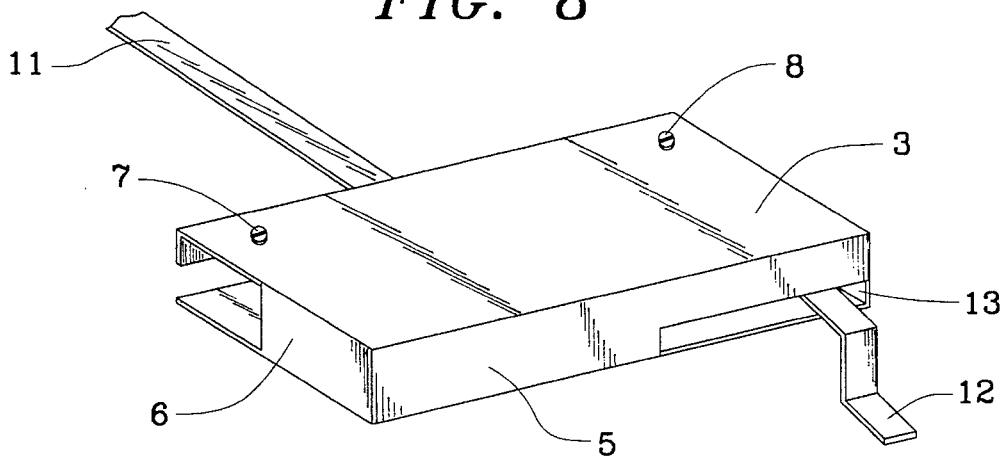
FIG. 8: Shows front cover and highlights bottom slot which allows for door trigger movement and inclement weather drainage.
Figure 9:
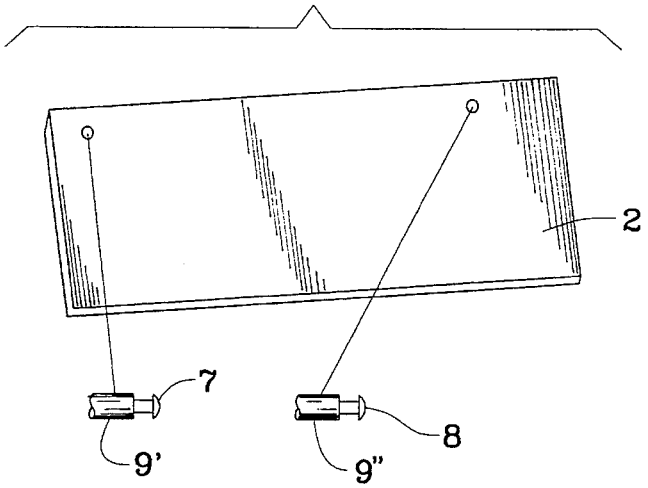
FIG. 9: Shows front and side view of backboard with exploded view of plastic swivel posts.

When mailman opens mailbox door to insert mail, the (5) trigger arm moves towards the back of the mailbox on the bottom, towards the front of the mailbox on the top, thus pulling the (3) flag connecting lever forward, which in turn pulls the (2) flag to a horizontal position which is then aided by gravity and continues a forward movement until it comes to rest on the (6) forward flag stop which is molded into the backboard. (see FIG. 3)

When customer removes mail from the mailbox and closes the mailbox door, the customer then re-positions the flag backwards into the non-signaling position and all movements of parts within the unit operate in an exact opposite direction. (see FIG. 4)

I claim:

1. A mail delivery signaling device comprising;

a rectangular enclosure having a backboard, a front cover, a top plate, a bottom plate, a side plate, first and second machine screws, first and second collars, forward flag stop, a flag, a trigger arm, and a flag connecting lever;

said enclosure attaching to the mail box by said first and second machine screws;

said machine screws pass through said front cover and said backboard;

said first and second machine screws being surrounded by a first and second collar that forms spacers between said front cover and said backboard;

said first and said second machine screws passing through holes drilled in the side of said mail box;

said first and second machine screws having acorn nuts threaded on the free ends which extend through said side of said mail box;

said second collar is positioned adjacent to said side plate and functions as a back flag stop;

said forward flag stop being firmly attached to said backboard;

said forward flag stop being located to support the vertical position of said flag;

said backboard having first and second attachment points;

said first attachment point having said trigger arm pivotally attached;

said second attachment point having said flag pivotally attached;

said trigger arm having a first end and a second end;

said first end of said trigger arm being pivotally attached to said flag connecting lever;

said second end of said trigger arm being shaped in a manner to engage the mail box door as it is lowered;

said flag connecting lever having a first and second end;

said first end of said flag connecting lever being pivotally attached to said trigger arm;

said second end of said flag connecting lever having a member attached at an angle to provide leverage for raising said flag;

said member of said second end of said flag connecting lever being an integral part of said flag connecting lever;

said flag connecting lever being pivotally connected to said flag adjacent to said end of said member of said flag connecting lever;

said flag having a first end and a second end;

said first end of said flag having a projection at a right angle from the surface of said flag;

said second end of said flag being "L" shaped;

said second end of said flag being pivotally connected to said flag connecting lever at the inner aspect of said right angle formed by said "L" shape of said second end of said flag;

said flag being pivotally connected to said flag connecting lever at a position adjacent to said second end of said flag;

said from flag stop being placed to engage the outer aspect of said "L"shape of said second end of said flag, said flag stop supporting said flag in a vertical position in respect to said bottom plate;

said bottom plate having a slot allowing movement of said trigger arm;

said trigger arm protruding through said slot in said bottom plate allowing said trigger arm to engage said mail box door;

said top plate having a slot allowing movement of said flag from a horizontal to vertical position;

said side plate having a slot adjacent to said top plate accommodating said flag in a vertical position; and, said second collar being located to act as back flag stop.

2. The mail delivery signaling device as claimed in claim 1 wherein said front cover, said backboard, said top cover, said side cover are formed from injection molded plastic.

3. The mail delivery signaling device as claimed in claim 2 wherein said molded plastic is clear plastic.

* * * * *

UNITED STATES PATENT AND TRADEMARK OFFICE

CERTIFICATE OF CORRECTION

PATENT NO. : 5,482,206

DATED : 9 Jan. 1996

INVENTOR(S) : Cecil M. Waycasy

It is certified that error appears in the above-indentified patent and that said Letters Patent is hereby corrected as shown below:

Column 2, line 4, "collar" should read --collars--;
line 10, "a" should be deleted, and
"collar" should read --collars--;
line 49, --13-- should appear after "slot";
line 54, --16-- should appear after "slot".

Signed and Sealed this

Thirteenth Day of August, 1996

*Attest:*

*Attesting Officer*

BRUCE LEHMAN

*Commissioner of Patents and Trademarks*